US008250986B1

(12) United States Patent
Sheridan et al.

(10) Patent No.: US 8,250,986 B1
(45) Date of Patent: Aug. 28, 2012

(54) THERMAL ENHANCED BLAST WARHEAD

(75) Inventors: Edward W. Sheridan, Orlando, FL (US); George D. Hugus, IV, Chuluota, FL (US); Filippo Bellomo, Orlando, FL (US); Daniel J. Martorana, Winter Park, FL (US); Ryan A. McCoy, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 360 days.

(21) Appl. No.: 12/348,690

(22) Filed: Jan. 5, 2009

Related U.S. Application Data

(60) Provisional application No. 61/018,780, filed on Jan. 3, 2008.

(51) Int. Cl.
*F42B 12/20* (2006.01)

(52) U.S. Cl. ..... 102/499; 102/491; 102/478; 102/473; 102/322; 102/332; 86/51; 86/50

(58) Field of Classification Search ..... 102/473, 102/475, 499, 477, 478, 491, 492, 318, 322, 102/331, 332; 86/51, 56
See application file for complete search history.

(56) References Cited

U.S. PATENT DOCUMENTS

| | | | | |
|---|---|---|---|---|
| 5,212,343 | A * | 5/1993 | Brupbacher et al. | 102/323 |
| 6,846,372 | B1 * | 1/2005 | Guirguis | 149/2 |
| 6,910,423 | B2 * | 6/2005 | Lloyd | 102/497 |
| 6,969,434 | B1 * | 11/2005 | Chan et al. | 149/19.5 |
| 7,363,860 | B2 | 4/2008 | Wilson et al. | |
| 7,614,348 | B2 * | 11/2009 | Truitt et al. | 102/491 |
| 7,717,042 | B2 * | 5/2010 | Lloyd | 102/497 |
| 7,845,282 | B2 * | 12/2010 | Sheridan et al. | 102/473 |
| 7,891,297 | B1 * | 2/2011 | Rohr | 102/492 |
| 8,033,223 | B2 * | 10/2011 | Sheridan et al. | 102/473 |
| 8,118,955 | B2 * | 2/2012 | Zavitsanos et al. | 149/19.3 |
| 2008/0251170 | A1 * | 10/2008 | Zavitsanos et al. | 149/22 |

FOREIGN PATENT DOCUMENTS

| | | | |
|---|---|---|---|
| JP | 2006526758 | | 11/2006 |
| JP | 2008522127 | A | 6/2008 |
| KR | 102008700118 | | 3/2008 |
| WO | WO 2009145926 | A1 * | 12/2009 |

* cited by examiner

*Primary Examiner* — James Bergin
(74) *Attorney, Agent, or Firm* — Jeffrey D. Myers; Peacock Myers, P.C.; Vernon Williams

(57) ABSTRACT

A warhead apparatus, method of making same, and method of detonating same comprising employing a high explosive core, an energetically and physically dense reactive material substantially surrounding the core, and a pressure vessel substantially surrounding the reactive material.

3 Claims, 2 Drawing Sheets

THERMAL ENHANCED BLAST WARHEAD

CROSS-REFERENCE TO RELATED APPLICATIONS

This application claims priority to and the benefit of the filing of U.S. Provisional Patent Application Ser. No. 61/018,780, entitled "Thermal Enhanced Blast Warhead", filed on Jan. 3, 2008, and the specification and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

FIELD OF THE INVENTION

1. Technical Field

The present invention relates to methods and devices for enhancing explosive effects.

2. Description of Related Art

Significant improvements in the destructive power of warheads can be achieved by increasing the impulse (i.e., time at pressure) of the warhead, as illustrated in FIG. 2. Such capability enables smaller warheads to create the same effect as much larger warheads. The miniaturization of the warhead has a ripple effect on the systems they are a part of, increasing available volume for propellants, sensors, actuators or other critical components in volume limited designs. Conversely, existing systems can be retrofitted to increase their effectiveness, expand target sets and potentially introduce selectable output. The present invention is a key technology building block in selectable effect munitions and inherently increases the Insensitive Munitions (IM) compliance of weapon systems.

BRIEF SUMMARY OF THE INVENTION

The present invention is of a warhead apparatus (and concomitant method of making and method of detonating) comprising: a high explosive core; an energetically and physically dense reactive material substantially surrounding the core; and a pressure vessel substantially surrounding the reactive material. In the preferred embodiment, a high explosive detonator is employed for the core, more preferably with an initiator for the reactive material, and most preferably with a timing element triggering the initiator before the detonator.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The warhead apparatus and method of the present invention provides unexpected benefits by combining certain enhanced blast design approaches into an integrated design. The preferred design elements include one or more of the following: (1) increase the energy density of the warhead using energy dense materials; (2) release the energy in a time frame fast enough to contribute to the positive pressure pulse generated by a detonable material; and (3) include dense particulate to generate multiphase flows.

The invention preferably incorporates these design elements by wrapping a high explosive core with an energetically and physically dense reactive material in a pressure vessel. The reactive material is triggered prior to detonation of the high explosive. The triggering of the reactive material prior to detonation of the explosive charge allows the slower reacting surround to completely release its stored chemical energy. Subsequent detonation of the explosive will rupture the pressure vessel and disperse the super heated reactive material in a multi-phase flow field. The reaction products of the reactive material surround will interact with the blast wind and will also after burn when exposed to additional ambient oxygen creating a significant enhancement in impulse. The invention is applicable to new warhead designs and existing systems can be retrofitted to increase their effectiveness, expand target sets, and introduce selectable output.

Figure 1:
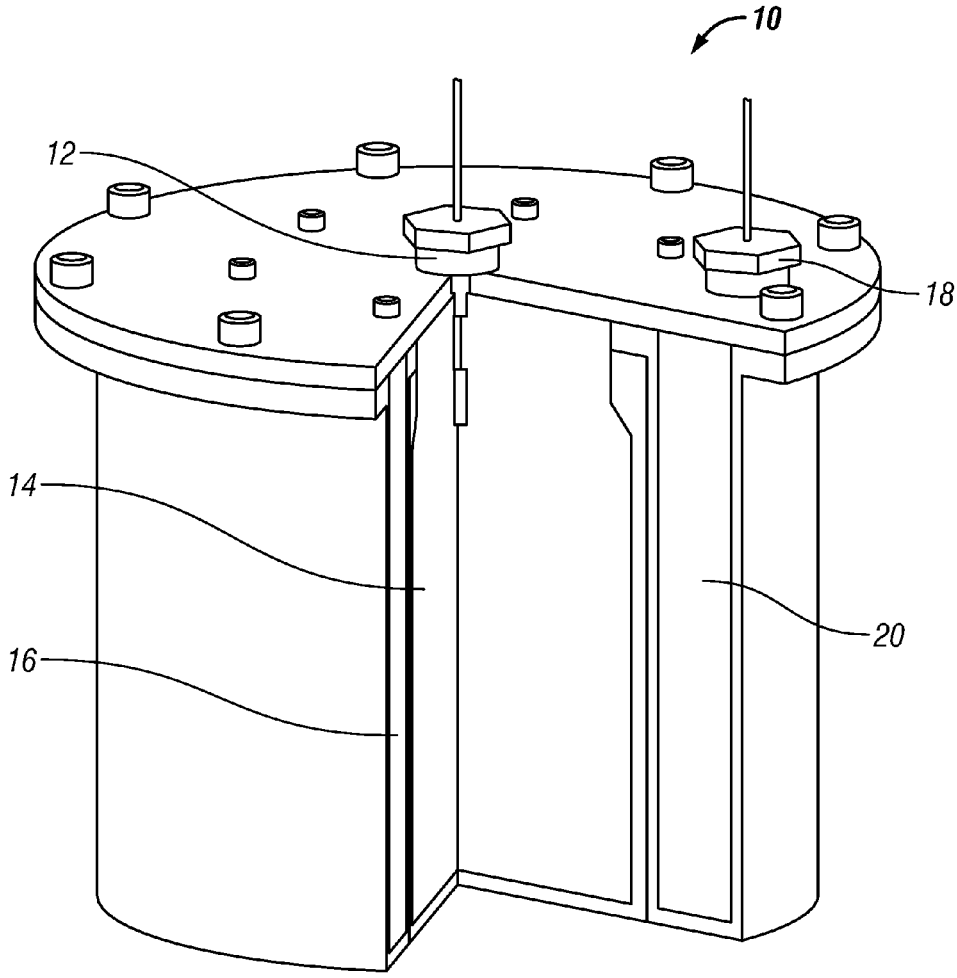
FIG. 1 is a perspective cutaway view of the preferred warhead of the invention.
Figure 2:
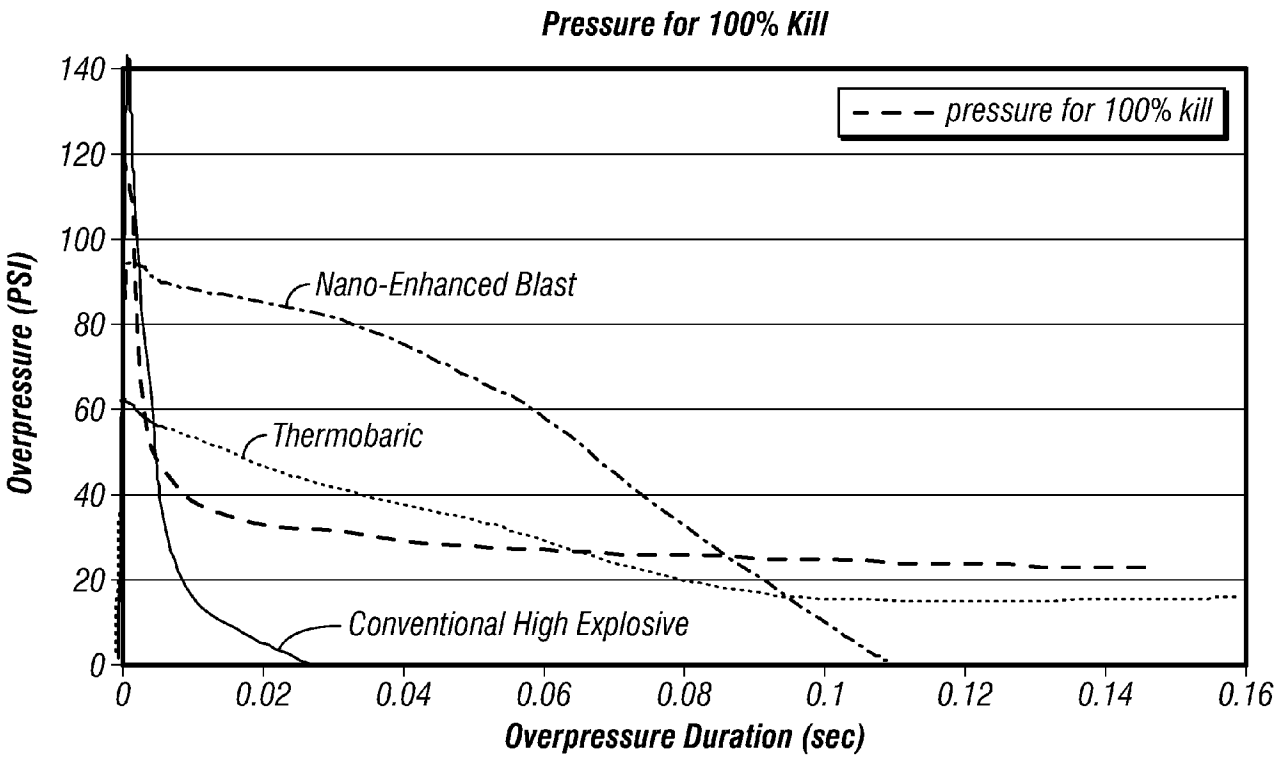
FIG. 2 is a graph of overpressure over time generated by conventional high explosive, thermobaric, and nano-enhanced blast technologies.

FIG. 1 illustrates the preferred warhead 10 of the invention, comprising high explosive detonator 12, high explosive (HE) 14, reactive material (RM) 16, and RM initiator 18. Preferably the RM surrounds the HE material.

The HE material, for purposes of the specification and claims, is any detonating explosive in either of two groups: primary and secondary. Primary high explosive is detonated by impact, spark, or flame; secondary high explosive requires a separate detonator. Both types can be combined in the invention, if desired. The HE detonator, if employed, preferably comprises primary high explosive combined with timing or percussion elements which ignite the primary explosive in order to detonate a main charge of secondary high explosive. Possibilities include trinitrotoluene or TNT, a shell-filler derived from nitroglycerine, amatol, a compound of TNT and ammonium nitrate, pentaerythritol or PETN, trimethylene trinitramine or RDX, tetramethylene tetranitramine or HMX, and combinations such as a combination of TNT, RDX, and aluminum (HBX), which forms a compound which produces a blast suitable for shattering hard substances, such as armor plate.

The RM preferably results in a super-heated multiphase RM reaction having products that will interact with expanding explosive gasses, thereby improving energy transfer to target. The RM also provides for increased energy density of warhead for increased impulse and is inherently IM compliant. RM for purposes of the specification and claims is any of the new class of materials being investigated as a means to increase the lethality of direct-hit or fragmentation warheads. RM are usually thermite-like pyrotechnic compositions of two or more nonexplosive solid materials, which stay inert and do not react with each other until subjected to a sufficiently strong mechanical stimulus, after which they undergo fast burning or explosion with release of high amount of chemical energy in addition to their kinetic energy. Fragments or projectiles made of such materials have therefore greater damaging effect than inert ones, with expected lethality increase up to 500%. RM materials include thermites, intermetallic compounds, metal-polymer mixtures (e.g., Magnesium/Teflon/Viton-like), metastable intermolecular composites (MIC), matrix materials, and hydrides. They are preferably strong enough to act as structural components and able to penetrate the target, sufficiently stable to survive handling and launch, and sufficiently unstable to reliably ignite on impact. Mixtures that are potentially suitable include one or more finely powdered (down to nanoparticle size) metalloids or metals like aluminum, magnesium, zirconium, titanium, tungsten, tantalum, or hafnium, with one or more oxidizers like teflon or other fluoropolymer, pressed or sintered or bonded by other method to a compact, high-density mass. To achieve a suitable reaction rate and insensitivity to impact, friction, and electrostatic discharge, fuel particles have sizes usually between 1-250 μm. One such composition is aluminum-teflon (Al-PTFE).

The RM initiator provides for pre-triggering, which increases efficiency of energy delivery and eliminates the need for nano-materials and overcomes slow reaction kinetics. The initiator can be explosive or non-explosive, as detailed in U.S. Pat. No. 7,363,860.

The enhanced blast effect of the invention derives from three sources having a synergistic combined effect: (1) increased energy content of the warhead, such as from use of energy dense fuel (e.g., Al, Zr, Ti, Hf, B, etc.); (2) increased efficiency of energy delivery, such as from increased burn rates of fuel by controlling microstructure (e.g., nano-materials, flakes, etc.); and (3) improved transfer of energy to the target from included dense particles to enhance energy transfer (e.g., Air Force Research Laboratory's dense inert metal explosive (DIME)).

Enhanced blast has been achieved previously, such as via one or more of: (1) incorporation of reactive energy dense materials as powders or flakes (e.g., aluminum, zirconium, titanium); (2) incorporation of nano-scale reactive materials as particles or flakes (e.g., nano-aluminum powder, ALEX, reactive thin films); and (3) incorporation of dense inert metal powders (e.g., tungsten). The present invention is superior to existing techniques because of at least the following: (1) It is superior to bulk blending of energy dense materials into explosives because the powders and flakes added do not react fast enough to contribute their stored energy into the initial blast pulse. The disclosed invention is superior in that the stored energy in the reactive material is released prior to the detonation event. (2) It is superior to incorporation of nano-materials in that nanomaterials will increase the burn rate of the energy dense material, but greatly increase the cost and manufacturing complexity of the warhead. Nano-materials can also increase the sensitivity of the warhead, and have a negative effect on shelf life. (3) It is superior to the addition of inert powder in that the same beneficial energy/target coupling effects can be achieved with this invention, but the overall effect is greatly increased.

Advantages of the invention include: (1) Requires no formulation qualification; (2) Inherently improved IM performance; (3) No exotic material requirements; (4) Potential of creating design spirals for existing products; and (5) The enhanced blast capabilities of the invention are particularly applicable to bunker, tunnel, and Military Operations in Urban Terrain (MOUT) defeat which are high priorities for the foreseeable future.

Note that in the specification and claims, "about" or "approximately" means within twenty percent (20%) of the numerical amount cited.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A warhead apparatus comprising:

a high explosive core which produces a blast suitable for shattering armor plate;

an energetically and physically dense reactive material substantially surrounding said core; and a pressure vessel substantially surrounding said reactive material;

a high explosive detonator for said core;

an initiator for said reactive material; and a timing element triggering said initiator before said detonator.

2. A method of making a warhead, the method comprising the steps of:

forming a high explosive core which produces a blast suitable for shattering armor plate;

substantially surrounding the core with an energetically and physically dense reactive material; and substantially surrounding the reactive material with a pressure vessel;

providing a high explosive detonator for the core;

providing an initiator for the reactive material; and providing a timing element triggering the initiator before the detonator.

3. A method of detonating a warhead, the method comprising the steps of:

forming a high explosive core which produces a blast suitable for shattering armor plate;

substantially surrounding the core with an energetically and physically dense reactive material;

substantially surrounding the reactive material with a pressure vessel; and detonating the high explosive core in an atmosphere via a high explosive detonator after first initiating the reactive material with an initiator via a timing element triggering the initiator before the detonator.

* * * * *